US005568886A

United States Patent [19]

Knickerbocker

[11] Patent Number: 5,568,886

[45] Date of Patent: Oct. 29, 1996

[54] COMBINED TURRET AND CLOSURE SEAL

[75] Inventor: Michael G. Knickerbocker, Crystal Lake, Ill.

[73] Assignee: AptarGroup, Inc., Cary, Ill.

[21] Appl. No.: 275,367

[22] Filed: Jul. 15, 1994

[51] Int. Cl.[6] ..... B65D 88/54

[52] U.S. Cl. ..... 222/321.9; 222/542

[58] Field of Search ..... 222/321.9, 542, 222/321.7

[56] References Cited

U.S. PATENT DOCUMENTS

| | | |
|---|---|---|
| 2,923,446 | 2/1960 | Ankney . |
| 2,980,300 | 4/1961 | Waddington et al. . |
| 3,128,018 | 4/1964 | Corsette et al. . |
| 3,231,156 | 1/1966 | Schultz . |
| 3,581,953 | 6/1971 | Donoghue . |
| 4,155,487 | 5/1979 | Blake . |
| 4,241,853 | 12/1980 | Pauls et al. . |
| 4,728,009 | 3/1988 | Schmidt . |

*Primary Examiner*—Gregory L. Huson
*Attorney, Agent, or Firm*—Frijouf, Rust & Pyle, P.A.

[57] ABSTRACT

An apparatus is disclosed for a combined turret and closure seal for a hand operated dispensing device having a closure for securing to a container to dispense a fluid from the container. The turret comprises a tubular portion and a gasket portion with the tubular portion engaging with the pump body. A closure is securable to the container and defines a closure shoulder. A boss is disposed on one of the tubular portion of said turret and the pump body for cooperating with the closure shoulder to interlock the turret and the pump body to the closure for securing the pump body to the container with the gasket portion of the turret providing a seal between.

20 Claims, 6 Drawing Sheets

COMBINED TURRET AND CLOSURE SEAL

BACKGROUND OF THE INVENTION

1. Field of the Invention

This invention relates to dispensing, and more particularly to an improved hand operated pump dispenser such as a trigger pump or a finger pump with a reduced volume of material and a reduced number of component parts required to manufacture the hand operated dispenser.

2. Background of the Invention

In a standard hand operated pump dispenser such as a trigger pump or a finger pump, a product is sealed within a container by a container closure. The container closure supports the hand operated pump commonly referred to as a finger pump. The hand operated pump communicates with a container through a dip tube for providing a fluid conduit between the hand operated pump and the bottom of the container. When the hand operated pump is actuated, the pump draws product from the bottom of the container through the dip tube to be dispensed by the pump from a terminal orifice.

In recent years, hand operated pumps have been used for dispensing a wide variety of commercial and personal health care products. In many cases, hand operated pumps have replaced aerosol dispensers for various reasons including environmental concerns regarding the use of aerosol products.

In general, aerosol dispensers are less expensive to manufacture than hand operated pumps. An aerosol dispenser is less expensive to manufacture since an aerosol dispenser is essentially a valve for controlling a pressurized aerosol propellant internal of a container. In contrast, the hand operated pump must generate an internal pressure within the pump for dispensing a product from a container. The component parts necessary to generate the internal pressure within the pump adds to the cost of the hand operated pump that are not required by an aerosol dispenser.

In anticipation of the expected increase in use of hand operated pumps to replace aerosol dispensers, the dispensing industry is exploring new designs and new assembly techniques to reduce the costs of hand operated pumps to be more commensurate with the cost of aerosol dispensers.

Although the cost of research, development, design and tooling for the construction of a hand operated pump may be substantial, the cost of a hand operated pump is essentially determined by the number of component parts of the hand operated pump and the material weight of each of the component parts of the hand operated pump. The material weight of each of the component parts is indicative of the amount of material required to fabricate the parts whereas the number of component parts is indicative of the complexity and cost of assembling the component parts into the hand operated pump.

U.S. Pat. No. 2,923,446 to Ankney discloses a thin walled can having an opening defined by a surface and a pouring spout of a pliant plastic material having a portion positioned within the opening and sealingly engaging the surface. The portion having a longitudinal passage with the portion before insertion in the opening having outer dimensions generally at least equal to the dimensions of the opening, the passage after the portion is inserted in the opening having predetermined dimensions longitudinally uniform at least for the length of the opening, and a rigid sleeve inserted in the passage after the portion is inserted in the opening, the sleeve having outer dimensions longitudinally uniform at least for the length of the opening and greater than the passage predetermined dimensions, but less than the opening dimensions, whereby when the sleeve is inserted into the passage after the portion is inserted in the opening, the material of the portion will be compressed between the sleeve and the opening surface.

U.S. Pat. No. 2,980,300 to Waddington et al discloses a sealed dispensing apparatus for a container which comprises a tubular plug of elastomeric material, a fluid dispensing device fitting the bore of the plug in fluid-tight relationship therewith and, surrounding the plug, a pair of flanges whose adjacent surfaces are spaced apart in the axial direction of the plug by a distance which is small in comparison with the diameter of the plug inside the flanges and forming a groove between the flanges, the first of the flanges being bounded over at least a part of its axial length with a surface whose diameter increases in the direction toward the groove, being of maximum peripheral size adjacent to the groove, having a minimum peripheral size which is, at most substantially equal to the peripheral size which is, at most substantially equal to the peripheral size of the plug on a section taken through the groove, and having a maximum peripheral size which is insufficient to prevent sufficient deformation of the elastomeric material while the shape of the bore of the plug is maintained constant by the fluid dispensing device, to allow passage of the first flange through an aperture leading from the outside to the inside of a container.

U.S. Pat. No. 3,128,018 to Corsette et al discloses a generally vertical cylindrical pump barrel having at its upper end a collar, with a plunger reciprocally disposed in the barrel and having at its upper end and above the collar a discharge head having a discharge orifice for fluid, spring means acting between the barrel and plunger for urging the plunger upwardly in the barrel, a check valve associated with the barrel to prevent downward movement of fluid therein, the plunger being formed to provide a discharge passage extending therethrough and communicating with the discharge orifice, means acting between the head and the collar to hold the head and plunger in a depressed and immobilized position against the action of the spring means, sealing means acting between the head and collar, the sealing means being rendered operative when the plunger is depressed and immobilized to seal the barrel to prevent leakage externally of the plunger, and means operable when the plunger is depressed and immobilized to seal the discharge passage to prevent leakage internally of the plunger, the last named means comprising coacting sealing surfaces relatively displaced into engagement to block flow of liquid through the discharge passage and hence to the orifice, the first named sealing means comprising a depending annular flange on the head having a peripheral bead thereon, a first surface on the collar engaged by the bead, and a second surface on the collar forming an acute angle with the first surface and engaging the flange when the head and plunger occupy the depressed and immobilized position to expand the flange and thereby to apply pressure between the bead and the first surface on the collar.

U.S. Pat. No. 3,231,156 to Schultz discloses a container comprising an end member having an opening therein and being provided with a rib-engaging surface; and a passaged nozzle received in the opening and secured to the end member, the nozzle being formed in one piece of a resilient plastic material and including a body portion insertable through the opening from the side directed toward the container interior, a radially directed flange adjacent the inner end of the body portion, a locking rib on the periphery of the body portion axially spaced from the flange, the rib being of a larger diameter than the opening and resiliently expanding to lock against the rib-engaging surface of the end member, the length of the body of the nozzle between the locking rib and the flange being slightly greater than the distance between the rib engaging surface and the inner surface of the breast portion of the end member thereby causing the resilient plastic material between the locking rib and flange to be locked and under tension between the rib engaging surface and the inner breast surface, and matching toothed serrations on the nozzle and on an inner surface of the end member extending around each of them at locations such that the serrations mesh and slide axially relative to one another upon nozzle installation and prevent relative rotation between the nozzle and the end member.

U.S. Pat. No. 3,581,953 to Donohue discloses a flexible walled container having first and second integrally formed chambers arranged one above the other, with an integrally formed separating wall therebetween. A tubular plug is threadably received in an insert fixed in an opening defined by the separating wall, and access to the plug is provided through a dispensing opening in the upper or second chamber. The plug carries a tube or conduit through which liquid can be forced by squeezing the lower or first chamber defining portion, and the plug has a laterally open passageway for directing the liquid toward the side of the second chamber to permit filling of the latter to a desired level after which the container can be inverted to dispense only that liquid in the second chamber.

U.S. Pat. No. 4,155,487 to Blake discloses a variable volume pump chamber formed by a flexible bulb having a flange on its upper end which serves as a gasket and carries depending flaps which form inlet and outlet check valves for the chamber. In two other arrangements, the pump chamber is formed by a piston and cylinder and the valve element is a separate member surrounding a cavity open to the pump chamber. A novel vent valve permits replacement air into the container on which the pump is used.

U.S. Pat. No. 4,241,853 to Pauls et al discloses a multifunction dispenser that may be adjusted to obtain a spray or stream of the material dispensed, either as a long duration discharge of the material or as intermittent discharges corresponding to actuation of a trigger actuator, or as a continuous discharge during actuations of the trigger, depending upon functional design variables. Structure is provided for storing an accumulated amount of material upon repeated operations of the trigger, for subsequent prolonged discharge of the material, or the accumulating structure may be bypassed for intermittent discharges of the material as the trigger is operated, or the accumulating structure may function as a holding chamber whereby a continuous discharge of the material may be obtained while the trigger is being operated.

U.S. Pat. No. 4,728,009 to Schmidt discloses a spray pump having a connecting portion connectable to a container and whose housing is provided with co-axially step bores defining a venting chamber for venting the container and a pump chamber. The pump piston has oppositely conically divergent lips engaging the walls of the respective chambers and is hollow to receive the restoring spring which can also bear upon a checkvalve ball.

Although hand operated dispensers are economical due to superior design and manufacturing techniques, the manufacturers of hand operated dispensers continue to strive to further increase the efficiency of manufacture. One significant method of reducing the manufacturing cost of hand operated dispensers is to reduce the volume of material required to manufacture the hand operated dispenser and to reduce the number of component parts required to manufacture the hand operated dispenser.

Therefore it is an object of the present invention to provide a combined turret and closure seal for a hand operated dispensing device wherein a hand operated pump can be manufactured with the elimination of one component part required by the pumps of the prior art.

Another object of this invention is to provide a combined closure turret and closure seal for a hand operated dispensing device that can be manufactured with one less component part and with substantially no material increase of the remaining components of the hand operated dispensing device.

Another object of this invention is to provide a combined turret and closure seal for a hand operated dispensing device that provides a reduction in both the number of component parts of the hand operated dispensing device and a reduction in the amount of material weight of the component parts of the hand operated dispensing device.

Another object of this invention is to provide a combined turret and closure seal for a hand operated dispensing device which is suitable for use on existing containers of conventional design.

Another object of this invention is to provide a combined turret and closure seal for a hand operated dispensing device which may be easily fabricated on existing assembly machines.

Another object of this invention is to provide a combined turret and closure seal for a hand operated dispensing device with reduced overall costs relative to the prior art with substantially the same dispensing performance.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a combined turret and closure seal for a hand operated dispensing device having a pump body for dispensing a fluid from a container. The improvement comprises a turret having a tubular portion and a gasket portion with the tubular portion of the turret engaging with the pump body. A boss is disposed on one of the tubular portion of the turret and the pump body. A closure is securable to the container with the closure having a closure shoulder for cooperating with the boss for interlocking the turret and the pump body to the closure for securing the pump body to the container with the gasket portion of the turret providing a seal therebetween.

In a more specific embodiment of the invention, the gasket portion of the turret is integral with the turret and extends radially outwardly from the tubular portion of the turret. Preferably, the turret is resilient whereas the pump body is substantially rigid. The tubular portion of the turret engages with the pump body for providing rigidity to the turret. The turret may include a crown for engaging with an end of the pump body. The turret may also have an inner tubular portion for engaging an inside surface of the pump body.

In one embodiment of the invention, the boss is disposed on the tubular portion of the turret with the closure shoulder engaging with the boss for interlocking the turret and the pump body to the closure. In another embodiment of the invention, the boss is disposed on the pump body for deforming the tubular portion of the turret for defining a boss projection thereon with the closure shoulder engaging with the boss projection for interlocking the turret and the pump body to the closure. Preferably, the closure shoulder comprises a cylindrical end of cylindrical portion of the closure for engaging with the boss for interlocking the turret and the pump body to the closure.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
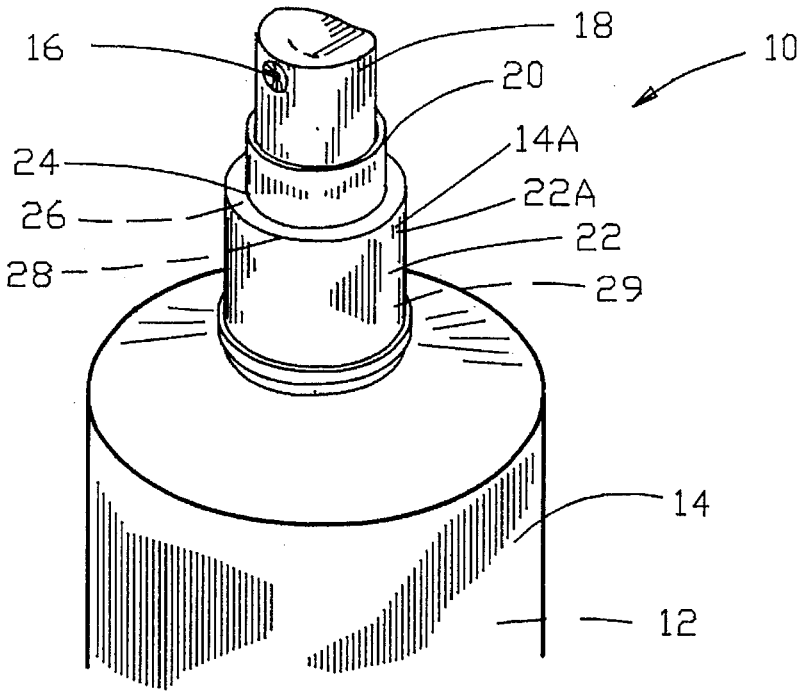
FIG. 1 is a partial isometric view of a hand operated pump secured to a container with an actuator located in an extended position.
Figure 2:
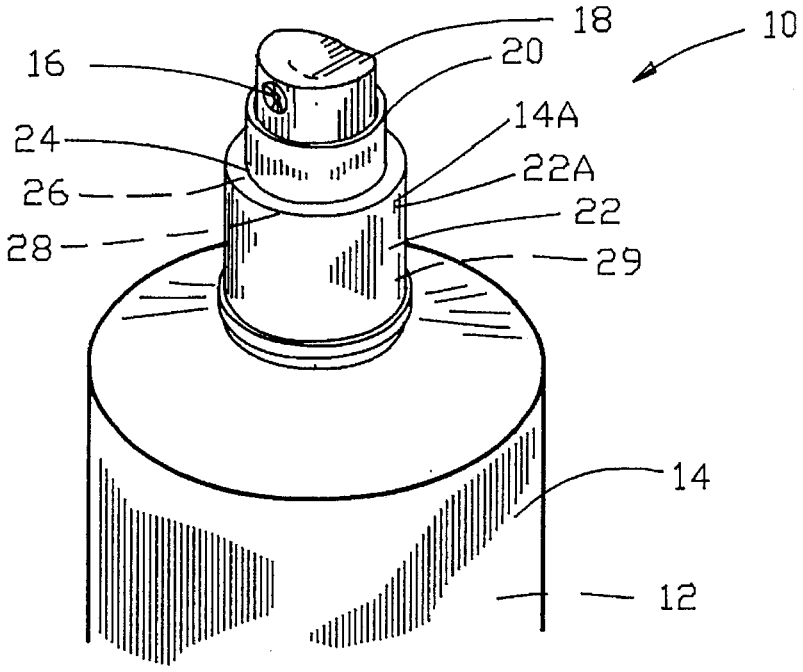
FIG. 2 is a partial isometric view of the hand operated pump of FIG. 1 with the actuator located in a retracted position.

FIGS. 1 and 2 are partial isometric views of a hand operated pump 10 for pumping a liquid 12 from a container 14 through a terminal orifice 16 located in an actuator 18. The actuator 18 is slidably disposed within a turret 20. The turret 20 is supported by a closure 22 with the turret 20 extending through a closure aperture 24 located in the closure 22.

The container 14 has a container rim 26 defining a container opening 28 for enabling the liquid 12 from the container 14 to be discharged from the terminal orifice 16. A securing means 29 secures the closure 22 to the container 14 as will be described in greater detail hereinafter. Preferably, the closure 22 has closure threads 22A for securing with container threads 14A extending circumferentially about the container rim 26 of the container 14 in a conventional fashion. In the alternative, the closure 22 may be secured in a snap locking engagement with the rim 26 of the container 14.

As will be described in greater detail hereinafter, the actuator 18 is slidably disposed within a turret 20 between an extended position shown in FIG. 1 and a retracted position shown in FIG. 2. The reciprocation of the actuator 18 between the extended position shown in FIG. 1 and the retracted position shown in FIG. 2 results in the pumping of the liquid 12 from the container 14 through the terminal orifice 16.

Figure 4:
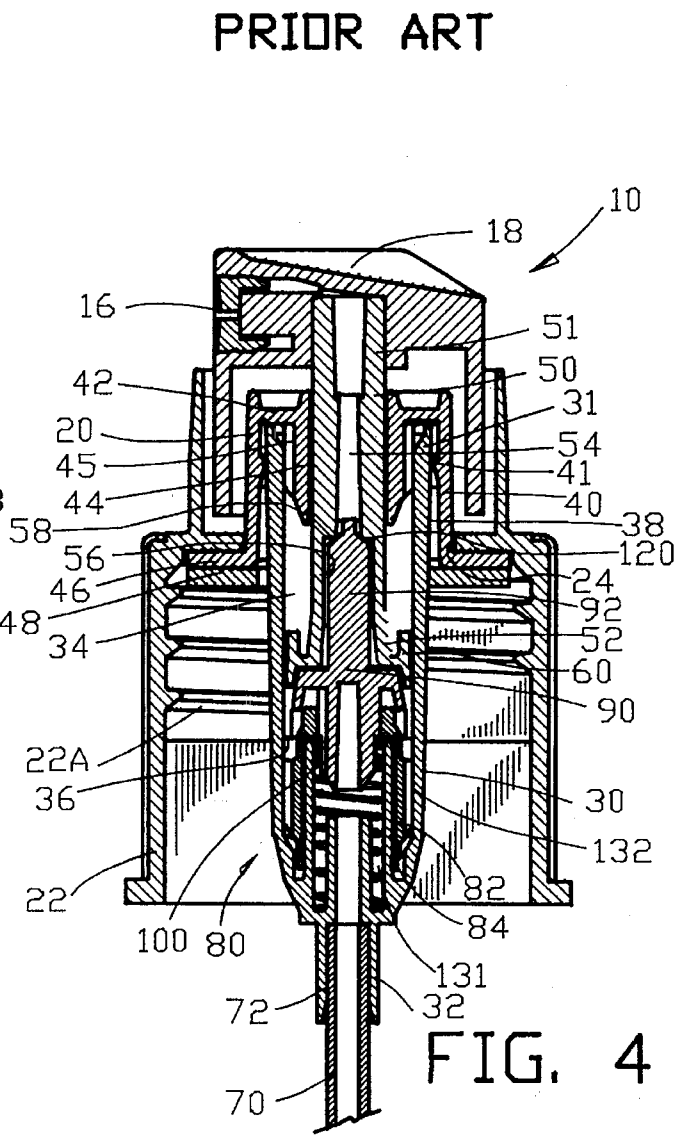
FIG. 4 is a side sectional view of the hand operated pump shown in FIG. 3 with the actuator being located in a retracted position.
Figure 3:
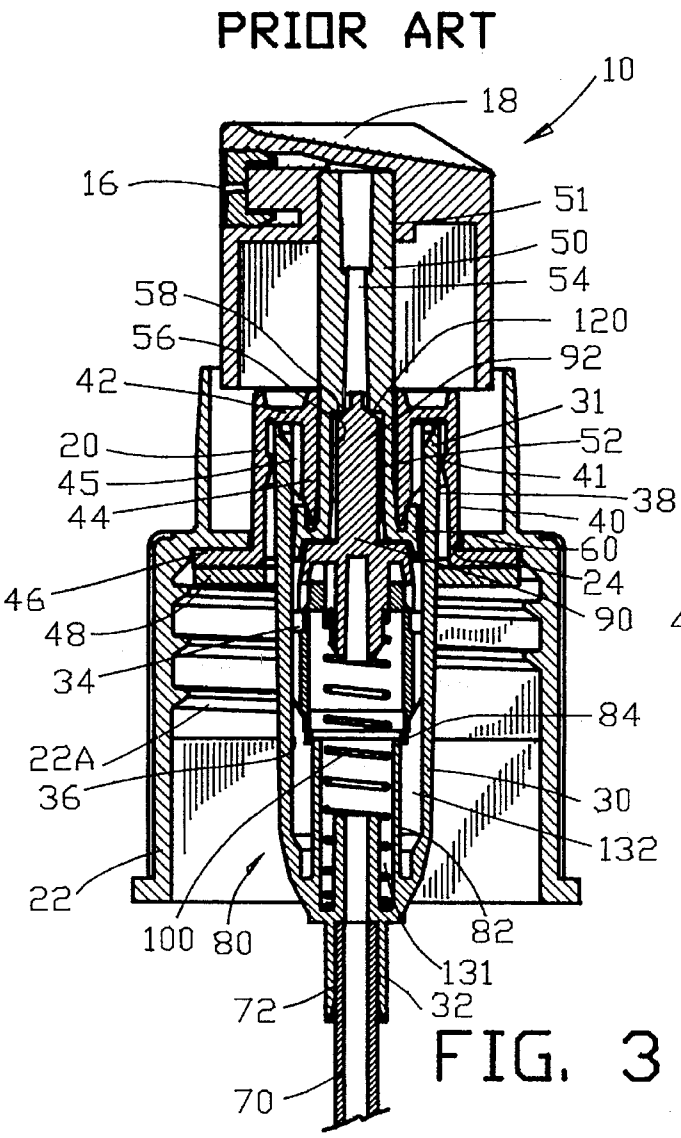
FIG. 3 is a side sectional view of a hand operated pump of the prior art with the actuator being located in an extended position.

FIGS. 3 and 4 are partial sectional views of the hand operated pump 10 of the prior art with FIG. 3 illustrating the hand operated pump 10 in the extended position and with FIG. 4 illustrating the hand operated pump 10 in the retracted position. The hand operated pump 10 illustrated in FIGS. 3 and 4 is similar to the pump set forth in U.S. Pat. No. 4,986,453.

The hand operated pump 10 comprises a body 30 having a first and a second body end 31 and 32 with an internal pump cylinder 34 disposed therebetween. The internal pump cylinder 34 defines an internal pump cylinder wall 36 whereas the body 30 defines an external pump body wall 38.

The turret 20 includes a tubular portion 40 having ribs 41 for engaging with the external pump body wall 38 of the pump body 30. An upper region of the turret 20 supports a crown 42 for engaging with the first end 31 of the pump body 30. The crown 42 has an inner tubular portion 44 having ribs 45 for engaging the internal pump cylinder wall 36 of the pump body 30. The ribs 41 and 45 interlock the turret 20 to the pump body 30. A lower region of the turret 20 supports a radially outwardly extending flange 46.

The aperture 24 of the closure 22 enables the tubular portion 40 to extend therethrough. An annular gasket 48 is interposed between the flange 46 and the container rim 26 of the container 14. When the closure threads 22A of the closure 22 are secured to the container threads 14A of the container 14, the extending flange 46 compresses the annular gasket 48 against the container rim 26 of the container 14 to seal the turret 20 and the pump body 30 to the container 14.

A pump stem 50 has a first stem end 51 extending external from the pump body 30 and a second stem end 52 extending internal the pump body 30 with an internal stem passage 54 extending through the pump stem 50. The first stem end 51 supports the actuator 18 with the terminal orifice 16 communicating with the internal stem passage 54 extending through the pump stem 50.

The second stem end 52 of the pump stem 50 is slidably disposed within the internal pump cylinder 34 of the body 30 and includes an annular seal 60 for frictionally engaging with the internal pump cylinder wall 36 to form a slidable seal between pump stem 50 and the internal pump cylinder wall 36 of the internal pump cylinder 34. The inner tubular portion 44 of the turret 20 provides a slidable support for the pump stem 50 and limits the extended position of the pump stem 50 and the actuator 16 upon the annular seal 60 engaging the inner tubular portion 44.

An induction tube 70 is frictionally secured into an induction tube aperture 72 integrally molded into the second body end 32 of the pump body 30. The induction tube 70 provides fluid communication between the liquid 12 within the container 14 and the internal pump cylinder 34 of the pump body 30.

A first one-way valve 80 is located proximate the second body end 32 of the pump body 30 for enabling the flow of the liquid 12 only from the container 14 into the internal pump cylinder 34 of the pump body 30. The first one-way valve 80 comprises a valve seat 82 shown as a cylindrical valve seat integrally molded with the pump body 30. The first one-way valve 80 includes a movable valve member 84 for sealing with the valve seat 82.

The moveable valve member 84 engages a poppet 90 interposed between the second end 52 of the pump stem 50 and the movable valve member 84. The poppet 90 has an extending portion 92 disposed within all enlarged region 56 of the internal stem passage 54 of the pump stem 50.

A spring 100 biases the valve member 84 into engagement with the poppet 90 and biases the poppet 90 into engagement with the pump stem 50. A second one-way valve 120 comprises the extending portion 92 of the poppet 90 being biased into engagement with a shoulder 58 defining the enlarged region 56 of the internal stem passage 54 of the pump stem 50.

As the actuator 18 is depressed by the operator, the movable valve member 84 seals with the valve seat 82 to close the first one-way valve 80. Continued depression of the actuator 18 by the operator reduces the volume of the inner chamber 131. When the actuator 18 is released by the operator, the inner chamber 131 is expanded to withdraw the liquid 12 from the container 14 into the inner chamber 131. The liquid 12 within the inner chamber 131 flows into an outer chamber 132 between the movable valve member 84 and the valve seat 82 upon the opening of the first one-way valve 80. The liquid 12 within the inner chamber 131 also flows into the outer chamber 132 between the poppet 90 and the movable valve member 84 upon separation thereof during the released of the actuator 18 by the operator.

Upon a subsequent depression of the actuator 18 by the operator, the movable valve member 84 seals with the valve seat 82 to close the first one-way valve 80 and to reform the inner chamber 131. The subsequent depression of the actuator 18 by the operator also reduces the volume of the outer chamber 132. The reduced volume of the outer chamber 132 increases the pressure therein to separate the extending portion 92 of the poppet 90 from the enlarged region 56 of the internal stem passage 54 of the pump stem 50 to open the second one-way valve 120. The opening of the second one-way valve 120 enables the liquid 12 within the outer chamber 132 to pass through the internal stem passage 54 of the pump stem 50 for discharge from the terminal orifice 16. A full description of the construction and operation of the pump 10 shown herein may be found in U.S. Pat. No. 4,986,453 which is hereby incorporated by reference into the present specification.

Figure 5:
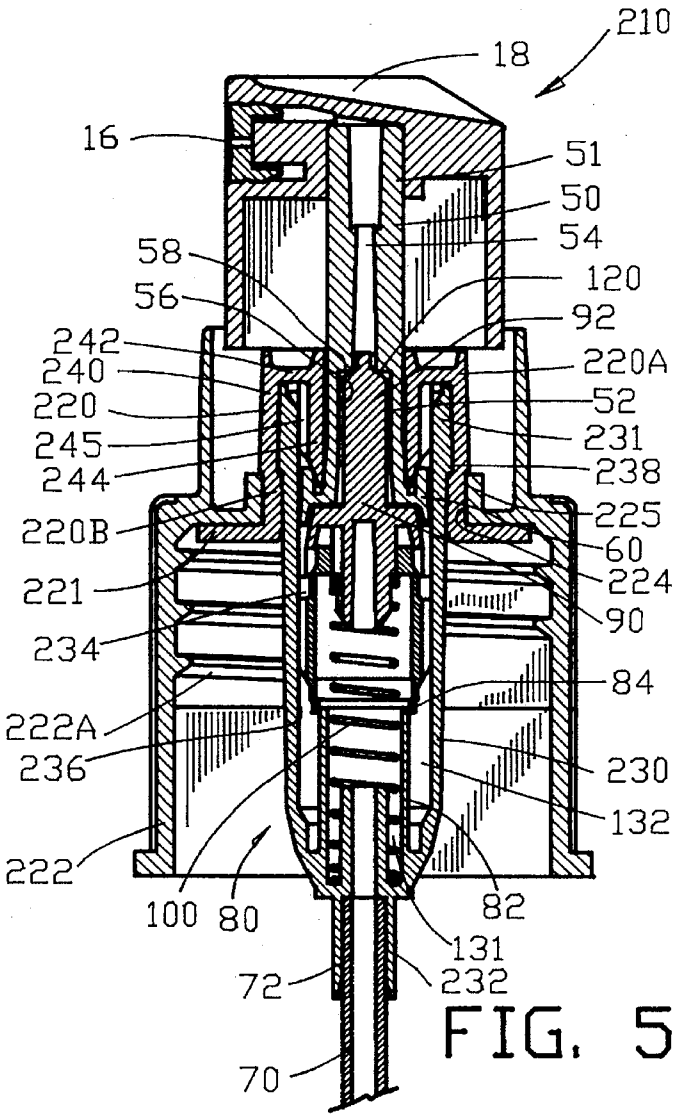
FIG. 5 is a side sectional view of a first embodiment of the combined turret and closure seal of the present invention for a hand operated pump with the actuator being located in the extended position.
Figure 6:
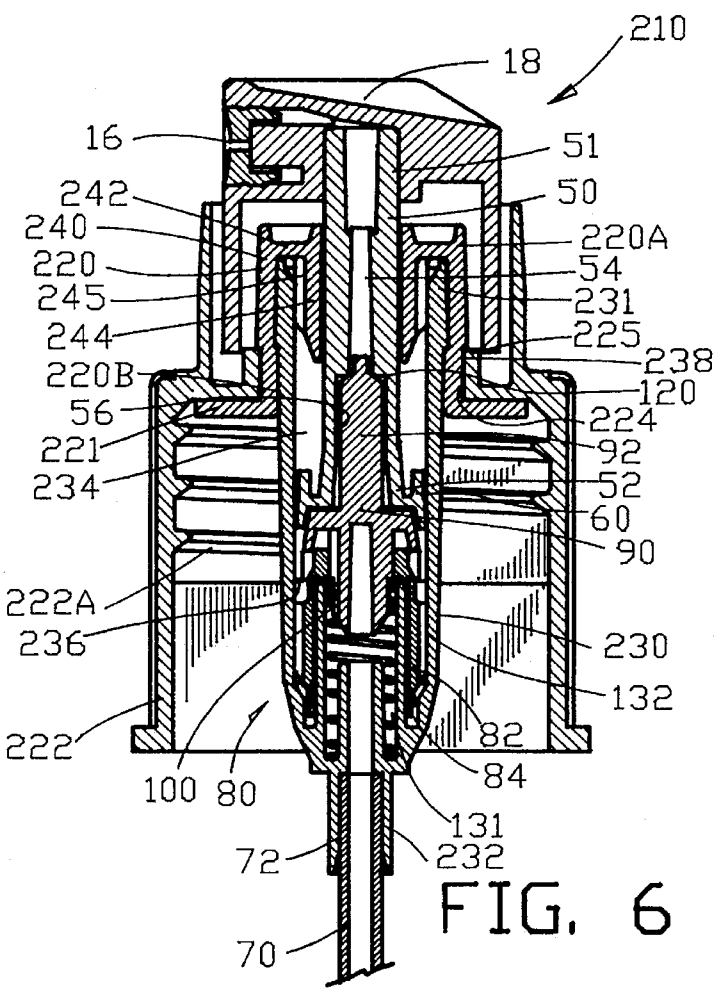
FIG. 6 is a side sectional view of the first embodiment of the combined turret and closure seal of the present invention shown in FIG. 5 with the actuator being located in the retracted position.

FIG. 5 is a side sectional view of a first embodiment of the combined turret 220 and closure seal 221 of the present invention for a hand operated pump 210 with an actuator 18 being located in the extended position. FIG. 6 is a side sectional view of the first embodiment of the combined turret 220 and closure seal 221 of the present invention shown in FIG. 5 with the actuator 18 being located in the retracted position. In a similar manner to FIGS. 3 and 4, a closure 222 has closure threads 222A for securing with the container threads 14A extending circumferentially about the container rim 26 of the container 14. An aperture 224 is defined by a closure collar 225 within the closure 222. The closure collar 225 is shown as a cylindrical collar disposed coaxially within the closure 222. Preferably, the closure 222 including the closure collar 225 is made of a substantially rigid material such as polypropylene or any other suitable material for providing a substantially rigid closure 222.

The combined turret 220 and closure seal 221 of the present invention may be used with a variety of different pumps of numerous configurations. For an example in the present specification, the hand operated pump 210 illustrated in FIGS. 5 and 6 is similar to the prior art pump 10 set forth in FIGS. 3 and 4 with similar reference numerals referring to similar parts of the respective pumps 10 and 210. However, it should be understood that the present invention is suitable for use other similar pumps. Furthermore, although the pump 210 has been shown as a vertical action pump 210 with a finger actuator 18, is should be understood that the present invention may be incorporated into a trigger pump of various configurations or other types of hand operated pumps.

The hand operated pump 210 comprises a body 230 having a first and a second body end 231 and 232 with an internal pump cylinder 234 disposed therebetween. The aperture 224 in the closure 222 enables the first body end 231 of the pump body 230 to extend therethrough. Preferably, the body 230 is made of a substantially rigid material such as polypropylene or any other suitable material for providing a substantially rigid pump body 230. The internal pump cylinder 234 defines an internal pump cylinder wall 236 whereas the body 230 defines an external pump body wall 238.

The turret 220 includes a tubular portion 240 having a crown 242 extending from an upper region of the turret 220A for engaging with the first end 231 of the pump body 230. The crown 242 supports all inner tubular portion 244 having ribs 245 for engaging the internal pump cylinder wall 236 of the pump body 230.

The closure seal 221 is integral with the turret 220 and extends radially outwardly from a lower region 220B of the tubular portion 240 of the turret 220. The closure seal 221 replaces the gasket 48 of the prior art hand operated pump 10 shown in FIGS. 3 and 4. The turret 220 including the crown 242, the inner tubular portion 244, the ribs 245 and the closure seal 221 are integrally formed of a resilient material such as polyethylene or any other resilient material having a flexibility of approximately 95 durometers. The tubular portion 240 of the turret 220 engages with the rigid pump body 230 for providing rigidity to the resilient turret 220 while enabling the closure seal 221 to remain flexible and resilient for providing a seal with the container 14.

FIGS. 7–10 illustrate a boss 250 for interlocking the turret 220 to the pump body 230. In this first embodiment of the invention, the boss 250 is disposed on the tubular portion 240 of the turret 220 for interlocking the turret 220 to the pump body 230. The boss 250 comprises a body projection 252 extending from the external pump body wall 238 for cooperating with a tubular portion recess 254 defined in an inside surface 256 of the tubular portion 240. A tubular portion projection 260 is defined on an outside surface 262 of the tubular portion 240. The tubular portion projection 260 cooperates with the tubular portion recess 254 for interlocking the turret 220 with the pump body 230.

Figure 7:
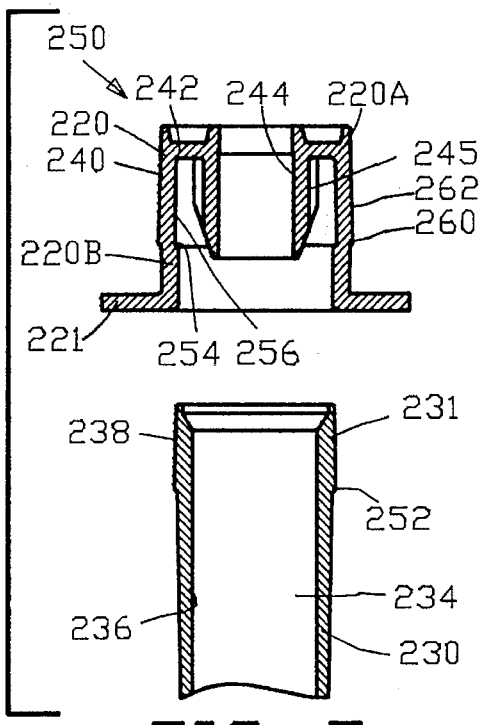
FIG. 7 is an exploded side sectional view of the combined turret and closure seal of FIGS. 5 and 6 prior to engagement of the turret with the pump body.

FIG. 7 is an exploded side sectional view of the combined turret 220 and closure seal 221 of FIGS. 5 and 6 prior to engagement of the turret with the pump body 230. The body projection 252 extending from the external pump body wall 238 is rigidly and integrally formed with the rigid pump body 230. The tubular portion recess 254 and the tubular portion projection 260 are resilient and integrally formed with the tubular portion 240.

Figure 8:
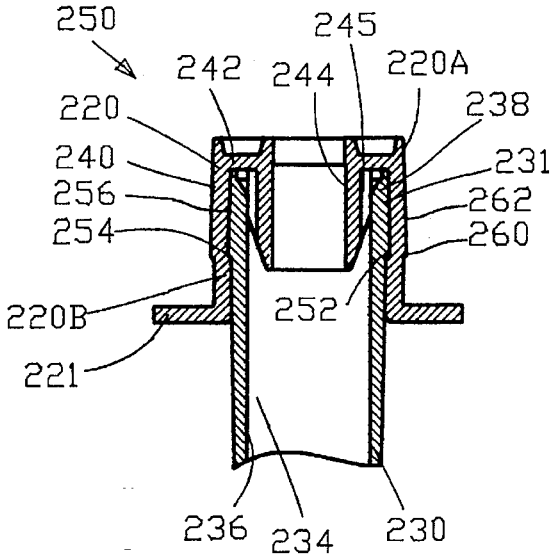
FIG. 8 is a side sectional view of the combined turret and closure seal of FIG. 7 with the turret engaging with the pump body.

FIG. 8 is a side sectional view of the combined turret 220 and closure seal 221 of FIG. 7 with the turret 220 interlocked with the pump body 230. The first end 231 of the pump body 230 is inserted between the tubular portion 240 and the inner tubular portion 244 of the turret 220. The body projection 252 is located in radial alignment with the tubular portion recess 254. The body projection 252 extending from the external pump body wall 238 is received within the tubular portion recess 254 of the turret 220 in a snap locking engagement for locking the pump body 230 to the turret 220. Once the body projection 252 is received within the tubular portion recess 254, the turret 220 is interlocked with the pump body 230.

Figure 9:
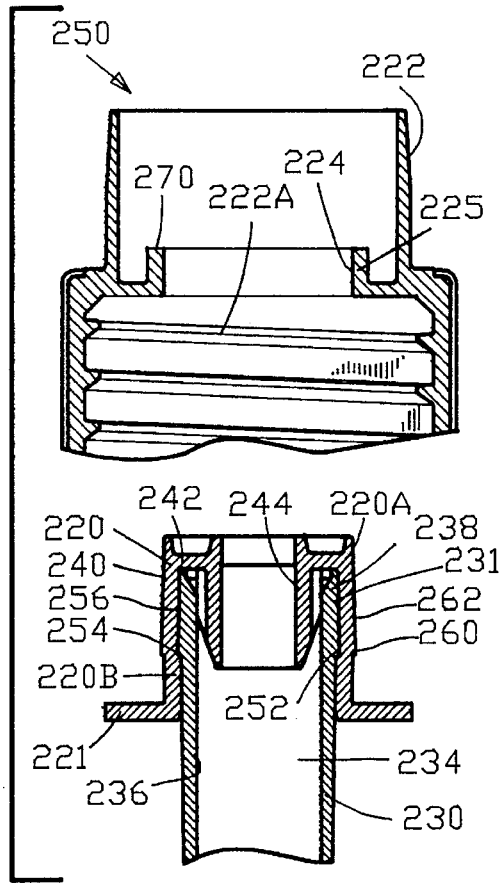
FIG. 9 is an exploded side sectional view of the combined turret and closure seal and pump body of FIG. 8 prior to engagement with a closure.

FIG. 9 is an exploded side sectional view of the combined turret 220 and closure seal 221 interlocked with the pump body 230 of FIG. 8 prior to engagement with the closure 222. The combined turret 220 and closure seal 221 interlocked with the pump body 230 are inserted from the bottom of the closure 222.

Figure 10:
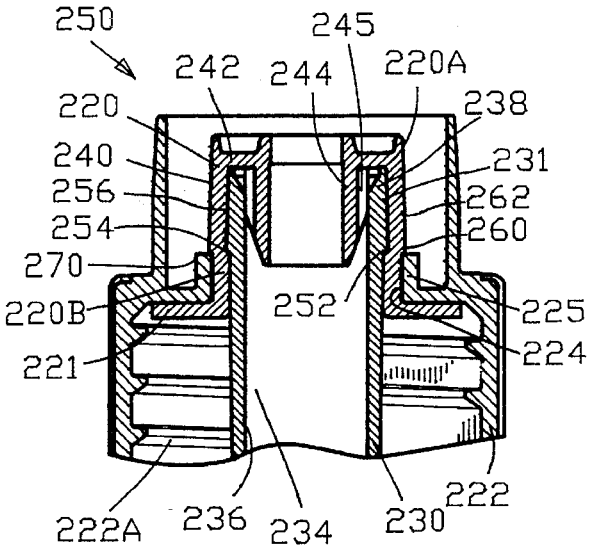
FIG. 10 is a side sectional view of the combined turret and closure seal and pump body of FIG. 8 with the turret engaging with the closure.

FIG. 10 is a side sectional view of the combined turret 220 and closure seal 221 interlocked with the pump body 230 of FIG. 8 with the turret 220 fastened to the closure 222. The closure collar 225 terminates in a closure shoulder 270 for cooperating with the boss 250 for fastening the interlocked turret 220 and the pump body 230 to the closure 222. In this embodiment, the closure shoulder 270 engages with the tubular portion projection 260 in a snap interlocking engagement for fastening the turret 220 to the closure 222.

The resilient turret 220 including the resilient tubular portion projection 260 is interposed between the rigid pump body 230 and the rigid closure collar 225 of the closure 222. The resilient tubular portion 240 and the resilient tubular portion projection 260 of the turret 220 are deformed for resiliently fastening the pump body 230 to the closure 222. Although the resilient tubular portion 240 resiliently fastens the pump body 230 to the closure 222, the rigidity of the pump body 230 and the closure collar 225 results in a substantially rigid fastening between the pump body 230 and the closure 222.

The closure threads 222A of the closure 222 secure the closure 222 to the container threads 14A of the container 14 in a conventional fashion. When the closure 222 is secured to the container 14, the closure seal 221 engages with the container rim 26 of the container 14 to seal the pump body 230 relative to the container 14. The present invention eliminates the need for a separate annular gasket 48 as required by the prior art hand operated pump 10 shown in FIGS. 3 and 4.

The hand operated pump 210 illustrated in FIGS. 5–10 operates in the same manner as the operation of the hand operated pump 10 set forth in FIGS. 3 and 4. It should be appreciated by those skilled in the art, that the combined turret 220 and closure seal 221 of FIGS. 7–10 may be use with a variety of pumps of diverse design.

Figure 12:
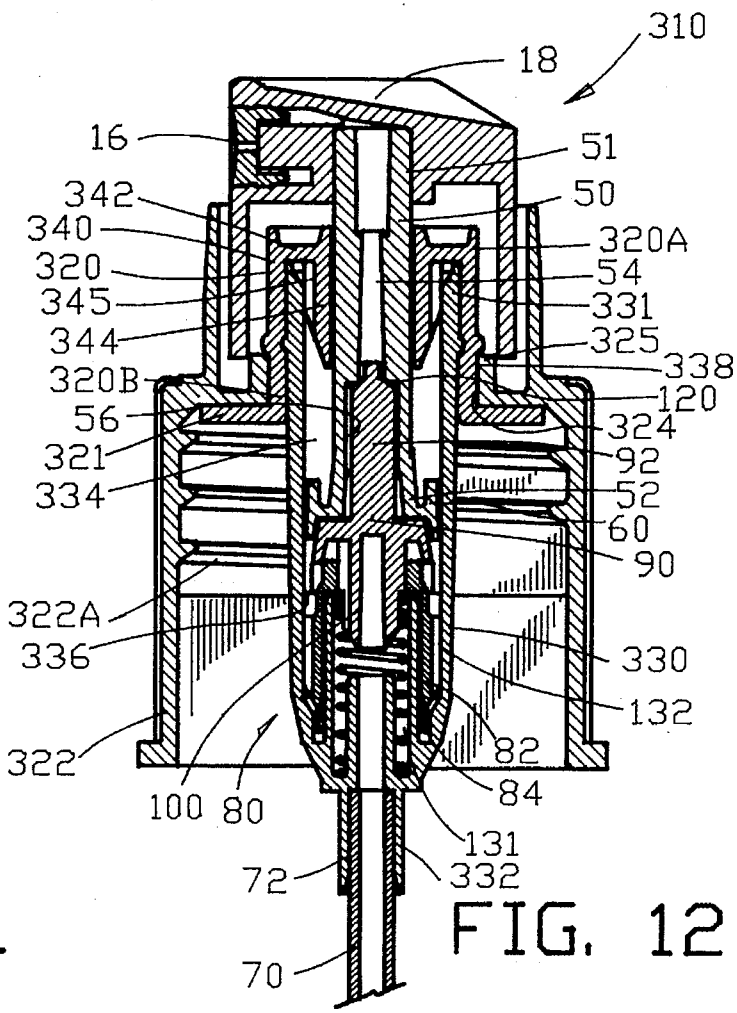
FIG. 12 is a side sectional view of the second embodiment of the combined turret and closure seal for a hand operated pump with the actuator located in the first retracted position.
Figure 11:
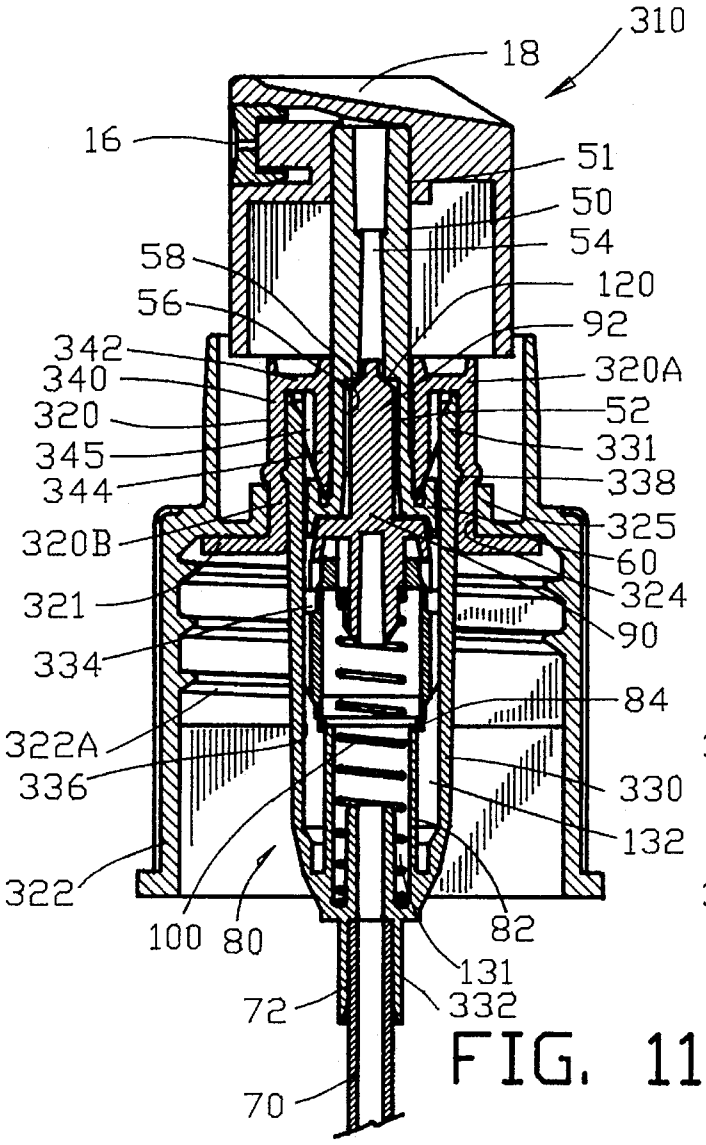
FIG. 11 is a side sectional view of a second embodiment of the combined turret and closure seal for a hand operated pump with the actuator located in the extended position.

FIG. 11 is a side sectional view of a second embodiment of the combined turret 320 and closure seal 321 of the present invention for a hand operated pump 310 with an actuator 18 being located in the extended position. FIG. 12 is a side sectional view of the second embodiment of the combined turret 320 and closure seal 321 of the present invention shown in FIG. 11 with the actuator 18 being located in the retracted position. In a similar manner to FIGS. 3 and 4, a closure 322 has closure threads 322A for securing with the container threads 14A extending circumferentially about the container rim 26 of the container 14. An aperture 324 is defined by a closure collar 325 within the closure 322. The closure collar 325 is shown as a cylindrical collar disposed coaxially within the closure 322. Preferably, the closure 322 including the closure collar 325 is made of a substantially rigid material such as polypropylene or any other suitable material for providing a substantially rigid closure 322.

The combined turret 320 and closure seal 321 of the present invention may be used with a variety of different pumps of numerous configurations. For an example in the present specification, the hand operated pump 310 illustrated in FIGS. 11 and 12 is similar to the prior art pump 10 set forth in FIGS. 3 and 4 with similar reference numerals referring to similar parts of the respective pumps 10 and 310. However, it should be understood that the present invention is suitable for use other similar pumps. Furthermore, although the pump 310 has been shown as a vertical action pump 310 with a finger actuator 18, is should be understood that the present invention may be incorporated into a trigger pump of various configurations or other types of hand operated pumps.

The hand operated pump 310 comprises a body 330 having a first and a second body end 331 and 332 with an internal pump cylinder 334 disposed therebetween. The aperture 324 in the closure 322 enables the first body end 331 of the pump body 330 to extend therethrough. Preferably, the body 330 is made of a substantially rigid material such as polypropylene or any other suitable material for providing a substantially rigid pump body 330. The internal pump cylinder 334 defines an internal pump cylinder wall 336 whereas the body 330 defines an external pump body wall 338.

The turret 320 includes a tubular portion 340 having a crown 342 extending from an upper region of the turret 320A for engaging with the first end 331 of the pump body 330. The crown 342 supports an inner tubular portion 344 having ribs 345 for engaging the internal pump cylinder wall 336 of the pump body 330.

The closure seal 321 is integral with the turret 320 and extends radially outwardly from a lower region 320B of the tubular portion 340 of the turret 320. The closure seal 321 replaces the gasket 48 of the prior art hand operated pump 10 shown in FIGS. 3 and 4. The turret 320 including the crown 342, the inner tubular portion 344, the ribs 345 and the closure seal 321 are integrally formed of a resilient material such as polyethylene or any other resilient material. The tubular portion 340 of the turret 320 engages with the rigid pump body 330 for providing rigidity to the resilient turret 320 while enabling the closure seal 321 to remain flexible and resilient for providing a seal with the container 14.

FIGS. 13–16 illustrate a boss 350 for interlocking the turret 320 to the pump body 330. In this second embodiment of the invention, the boss 350, comprises a body projection 352 extending from the external pump body wall 338. The tubular portion 340 of the turret 320 defines an inside surface 356 and an outside surface 362.

Figure 13:
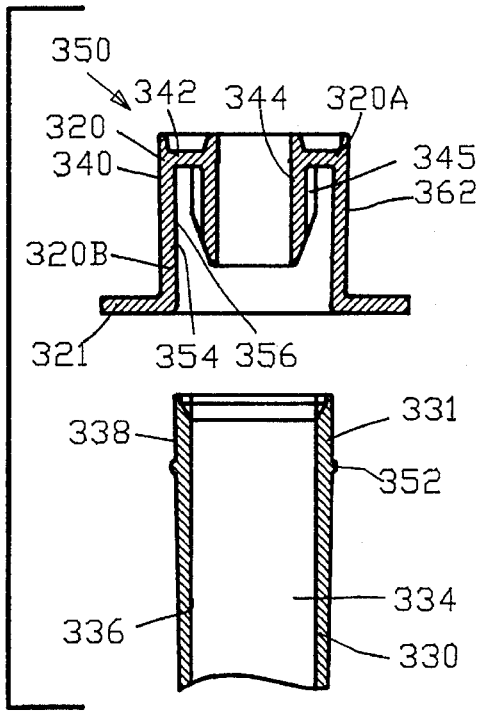
FIG. 13 is an exploded side sectional view of the combined turret and closure seal of FIGS. 11 and 12 prior to engagement of the turret with the pump body.

FIG. 13 is an exploded side sectional view of the combined turret 320 and closure seal 321 of FIGS. 11 and 12 prior to engagement of the turret 320 with the pump body 330. The body projection 352 extending from the external pump body wall 338 is rigidly and integrally formed with the rigid pump body 330. The tubular portion 40 is resilient between the inside surface 356 and the outside surface 362.

Figure 14:
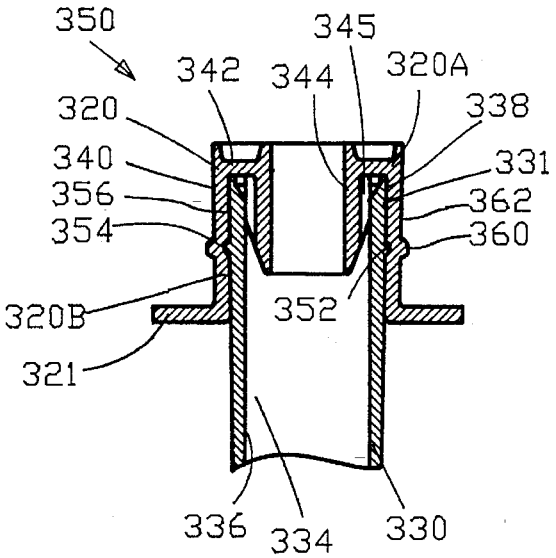
FIG. 14 is a side sectional view of the combined turret and closure seal of FIG. 13 with the turret engaging with the pump body.

FIG. 14 is a side sectional view of the combined turret 320 and closure seal 321 of FIG. 13 with the turret 320 interlocked with the pump body 230. The first end 331 of the pump body 330 is inserted between the tubular portion 340 and the inner tubular portion 344 of the turret 320. The body projection 352 deforms the tubular portion 340 of the turret 320 for forming a tubular portion recess 354 defined in the inside surface 356 of the tubular portion 340. Since the tubular portion 340 of the turret 320 is made of a resilient material, the material cold flows over a period of days to permanently form the tubular portion recess 354. The body projection 352 is received within the tubular portion recess 354 for interlocking the turret 320 with the pump body 330. The body projection 352 further deforms the tubular portion 340 of the turret 320 for forming a projecting deformation 360 on the outside surface 362 of the tubular portion 340.

Figure 15:
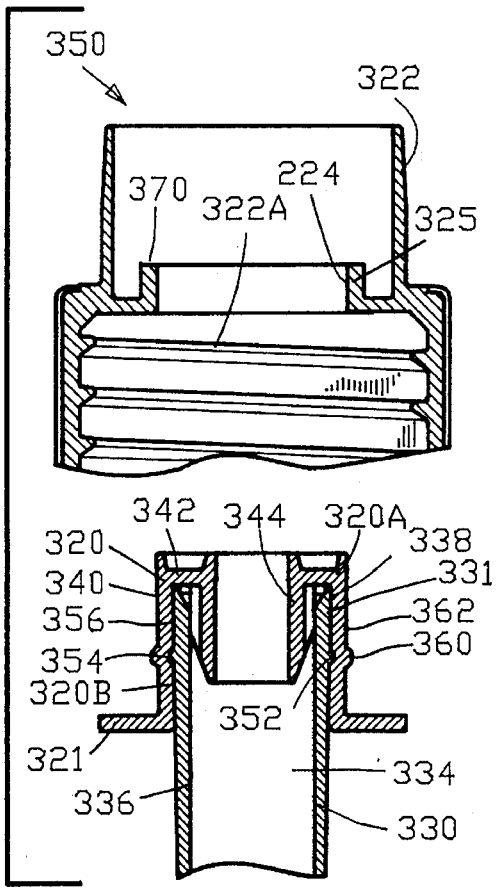
FIG. 15 is an exploded side sectional view of the combined turret and closure seal and pump body of FIG. 13 prior to engagement with a closure.

FIG. 15 is an exploded side sectional view of the combined turret 320 and closure seal 321 interlocked with the pump body 330 of FIG. 14 prior to engagement with the closure 320. The combined turret 320 and closure seal 321 interlocked with the pump body are inserted from the bottom of the closure 322.

Figure 16:
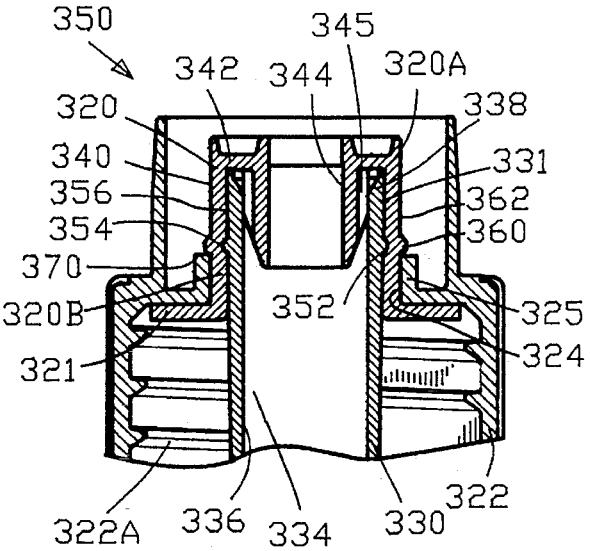
FIG. 16 is a side sectional view of the combined turret and closure seal and pump body of FIG. 13 with the turret engaging with the closure.

FIG. 16 is a side sectional view of the combined turret 320 and closure seal 321 interlocked with the pump body 330 of FIG. 14 with the turret 320 fastened to the closure 322. The closure collar 325 terminates in a closure shoulder 370 for cooperating with the boss 350 for fastening the interlocked turret 320 and the pump body 330 to the closure 322. In this embodiment, the closure shoulder 370 engages with the projection deformation 360 in a snap interlocking engagement for fastening the turret 320 to the closure 322.

The resilient turret 320 including the resilient projection deformation 360 is interposed between the rigid pump body 330 and the rigid closure collar 325 of the closure 322. The resilient tubular portion 340 and the resilient projection deformation 360 of the turret 320 are deformed for resiliently fastening the pump body 330 to the closure 322. Although the resilient tubular portion 340 resiliently fastens the pump body 330 to the closure 322, the rigidity of the pump body 330 and the closure collar 325 results in a substantially rigid fastening between the pump body 330 and the closure 322.

The closure threads 322A of the closure 322 secure the closure 322 to the container threads 14A of the container 14 in a conventional fashion. When the closure 322 is secured to the container 14, the closure seal 321 engages with the container rim 26 of the container 14 to seal the pump body 330 relative to the container 14. The present invention eliminates the need for a separate annular gasket 48 as required by the prior art hand operated pump 10 shown in FIGS. 3 and 4.

The hand operated pump 310 illustrated in FIGS. 11–16 operates in the same manner as the operation of the hand operated pump 10 set forth in FIGS. 3 and 4. It should be appreciated by those skilled in the art, that the combined turret 320 and closure seal 321 of FIGS. 11–16 may be use with a variety of pumps of diverse design.

Most structural parts in a prior art hand operated pumps as illustrated by pump 10 in FIGS. 3 and 4 are molded of a rigid material to provide the proper structural strength for the pump 10. If a flexible or resilient material is used for a structural part in the prior art hand operated pump 10, then a structural failure will occur and the pumps 10 will disassemble. Since the rigid material is not sufficiently flexible to act as a seal, the prior art hand operated pump 10 required the separate gasket 48 for sealing the pump body 30 to the closure 22.

The combined turret 220 and 320 and closure seal 221 and 321 of the present invention is fabricated of a resilient material for providing the proper flexibility for the closure seal 221 and 321. The resilient turret 220 and 320 is interposed between the rigid pump body 230 and 330 and the rigid closure collar 235 and 325 of the closure 222 and 322 to retain and strengthen the turret 220 and 320. The resilient turret 220 and 320 is deformed for resiliently fastening the pump body 230 and 330 to the closure 222 and 322. The collar 325 of the closure 222 and 322 provides a hoop to fasten the pump body 230 and 330 to the closure 222 and 322.

The resilient turret 220 and 320 functions as a bushing between the rigid pump body 230 and 330 and the closure 222 and 322 and provides structural strength to the turret 220 and 320. The configuration of the resilient turret 220 and 320 being interposed between the rigid pump body 230 and 330 and the rigid closure 222 and 322 provides the proper structural strength to fastening between the pump body 230 and 330 and the closure 222 and 322. However, the configuration of the resilient turret 220 and 320 allows the closure seal 221 and 321 to replace the separate gasket 48 of the prior art. Accordingly, the improved hand operated pump 210 and 310 of the present invention has the benefits of one less component part and one less part to assemble to reduce the overall cost to manufacture the pump 210 and 310.

Furthermore, the present invention eliminates the possibility of a defective pump as a result of a missing or improperly positioned gasket.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A combined turret and closure seal for a hand operated dispensing device having a substantially rigid pump body for dispensing a fluid from a container, the improvement comprising:

a resilient turret having a resilient tubular portion and a resilient gasket portion;

said resilient tubular portion of said resilient turret engaging the substantially rigid pump body;

a boss disposed on one of said tubular portion of said turret and the pump body;

a closure being securable to the container; and said closure having a closure shoulder for cooperating with said boss for interlocking said pump body to said closure with said resilient turret interposed therebetween to secure the pump body to the container with said resilient gasket portion of said turret providing a seal therebetween.

2. A combined turret and closure seal for a hand operated dispensing device as set forth in claim 1, wherein said gasket portion of said turret is integral with said turret.

3. A combined turret and closure seal for a hand operated dispensing device as set forth in claim 1, wherein said gasket portion of said turret is integral with said turret and extends radially outwardly from said tubular portion of said turret.

4. A combined turret and closure seal for a hand operated dispensing device as set forth in claim 1, wherein said turret includes a crown for engaging with an end of said pump body.

5. A combined turret and closure seal for a hand operated dispensing device as set forth in claim 1, wherein said turret includes a crown for engaging with an end of said pump body; and said crown having an inner tubular portion for engaging an inside surface of the pump body.

6. A combined turret and closure seal for a hand operated dispensing device as set forth in claim 1, wherein said boss is disposed on said tubular portion of said turret; and said closure shoulder engaging with said boss for interlocking said turret and said pump body to said closure.

7. A combined turret and closure seal for a hand operated dispensing device as set forth in claim 1 wherein said closure shoulder comprises a cylindrical end of a cylindrical portion of said closure engaging with said boss for interlocking said turret and said pump body to said closure.

8. A combined turret and closure seal for a hand operated dispensing device for dispensing a fluid from a container, the improvement comprising:

a substantially rigid pump body;

a resilient turret having a resilient tubular portion and a resilient gasket portion;

said gasket portion of said resilient turret being integral with said turret and extending radially outwardly from said tubular portion of said turret;

said tubular portion of said resilient turret engaging with the pump body for providing rigidity to said turret;

a boss disposed on one of said tubular portion of said turret and the pump body;

a closure being securable to the container; and said closure having a closure shoulder for cooperating with said boss for interlocking said pump body to said closure with said resilient turret interposed therebetween for securing the pump body to the container with said resilient gasket portion of said resilient turret providing a seal therebetween.

9. A combined turret and closure seal for a hand operated dispensing device as set forth in claim 8, wherein said turret includes a crown for engaging with an end of said pump body.

10. A combined turret and closure seal for a hand operated dispensing device as set forth in claim 8, wherein said turret includes a crown for engaging with an end of said pump body; and said crown having an inner tubular portion for engaging an inside surface of the pump body.

11. A combined turret and closure seal for a hand operated dispensing device as set forth in claim 8, wherein said boss is disposed on said tubular portion of said turret; and said closure shoulder engaging with said boss for interlocking said turret and said pump body to said closure.

12. A combined turret and closure seal for a hand operated dispensing device as set forth in claim 8, wherein said closure shoulder comprises a cylindrical end of cylindrical portion of said closure for engaging with said boss for interlocking said turret and said pump body to said closure.

13. A combined turret and closure seal for a hand operated dispensing device for dispensing a fluid from a container, the improvement comprising:

a substantially rigid pump body;

a resilient turret having a resilient tubular portion and a resilient gasket portion;

said gasket portion of said turret being integral with said turret and extending radially outwardly from said tubular portion of said turret;

said tubular portion of said turret engaging with the pump body for providing rigidity to said turret;

a boss disposed on one of said tubular portion of said turret and the pump body;

a closure being securable to the container; and said closure having a closure shoulder for cooperating with said boss for interlocking said pump body to said closure with said resilient turret interposed therebetween for securing the pump body to the container with said resilient gasket portion of said turret providing a seal therebetween.

14. A combined turret and closure seal for a hand operated dispensing device as set forth in claim 13, wherein said turret includes a crown for engaging with an end of said pump body.

15. A combined turret and closure seal for a hand operated dispensing device as set forth in claim 13, wherein said turret includes a crown for engaging with an end of said pump body; and said crown having an inner tubular portion for engaging an inside surface of the pump body.

16. A combined turret and closure seal for a hand operated dispensing device as set forth in claim 13, wherein said boss is disposed on said tubular portion of said turret; and said closure shoulder engaging with said boss for interlocking said turret and said pump body to said closure.

17. A combined turret and closure seal for a hand operated dispensing device as set forth in claim 13, wherein said closure shoulder comprises a cylindrical end of a cylindrical portion of said closure for engaging with said boss for interlocking said turret and said pump body to said closure.

18. A combined turret and closure seal for a hand operated pump as set forth in claim 13, wherein said container has a container rim defining a container opening;

said closure having a central opening for receiving said tubular portion of said turret therein;

said gasket portion of said turret being extending radially outwardly from said tubular portion of said turret for engaging with said container rim; and securing means for securing said closure to the container for enabling said gasket portion to form a seal with said container rim.

19. A combined turret and closure seal for a hand operated dispensing device for dispensing a fluid from a container having a container rim defining a container opening, the improvement comprising:

a substantially rigid pump body;

a resilient turret having a resilient tubular portion and a resilient gasket portion;

said gasket portion of said turret being integral with said turret and extending radially outwardly from said tubular portion of said turret;

said tubular portion of said turret engaging with the pump body for providing rigidity to said turret;

a boss disposed on one of said tubular portion of said turret and the pump body;

a closure being securable to the container;

said closure having a central opening for receiving said tubular portion of said turret therein with said gasket portion of said turret extending radially outwardly from said tubular portion of said turret for engaging with said container rim;

securing means for securing said closure to the container for enabling said gasket portion to form a seal with said container rim; and said closure having a closure shoulder for cooperating with said boss for interlocking said pump body to said closure with said resilient turret interposed therebetween for securing the pump body to the container with said resilient gasket portion of said turret providing a seal therebetween.

20. A combined turret and closure seal for a hand operated pump for dispensing a variable volume of liquid from a container, comprising in combination:

a substantially rigid pump body having a first and a second body end with an internal pump cylinder interposed therebetween;

a resilient turret having a resilient tubular portion and a resilient gasket portion;

said tubular portion of said turret engaging with the pump body;

a boss disposed on one of said tubular portion of said turret and the pump body;

a closure being securable to the container;

said closure having a closure shoulder for cooperating with said boss for interlocking said pump body to said closure with said resilient turret interposed therebetween for securing the pump body to the container with said resilient gasket portion of said turret providing a seal therebetween;

an induction tube affixed to said second body end of said pump body for providing fluid communication between the liquid within the container and said internal pump cylinder of said pump body;

a first one-way valve for enabling the flow of the liquid only from the container into said internal pump cylinder of said pump body;

a piston slidably disposed within said internal pump cylinder of said pump body;

a terminal orifice communicating with said internal pump cylinder of said pump body;

a spring for biasing said piston into an extended position;

a second one-way valve for enabling the flow of the liquid only from said internal pump cylinder into said terminal orifice; and said piston discharging a volume of the liquid from the container through said terminal orifice upon a longitudinal movement of said piston from said extended position to a retracted position by an operator.

* * * * *